United States Patent [19]

Krantz et al.

[11] 4,400,913

[45] Aug. 30, 1983

[54] COUNTERBALANCE PINION FOR VEHICLE WINDOW REGULATOR

[75] Inventors: Emerson H. Krantz, Roseville; Russell H. Peebles, Grosse Pointe Park, both of Mich.

[73] Assignee: Chrysler Corporation, Highland Park, Mich.

[21] Appl. No.: 274,041

[22] Filed: Jun. 15, 1981

[51] Int. Cl.[3] ..... E05F 11/48

[52] U.S. Cl. ..... 49/352; 49/374

[58] Field of Search ..... 49/352, 227, 374, 325

[56] References Cited

U.S. PATENT DOCUMENTS 4,229,906 10/1980 Pickles ..... 49/352

FOREIGN PATENT DOCUMENTS 56-57510 5/1981 Japan ..... 49/352

607254 8/1948 United Kingdom ..... 49/352

*Primary Examiner*—Kenneth Downey

*Attorney, Agent, or Firm*—Newtson and Dundas

[57] ABSTRACT

A counterbalance pinion gear arrangement for a vehicle window regulator employing a guide track and flexible rack rotary-to-linear motion converter. The pinion gear is meshed with the rack and includes a spiral spring operative upon translation of the rack to rotate the pinion. The spiral spring stores energy when the window is lowered such that the spring assists in raising the window. The pinion may be used interchangeable on either side of a vehicle by providing a mirror image spring capturing cleat formed on the radial interior of the pinion rim releasably retaining a hooked end of the spiral spring. The pinion gear teeth have a blank portion to prevent inadvertent disassembly of the regulator prior to its mounting in a vehicle.

2 Claims, 3 Drawing Figures

COUNTERBALANCE PINION FOR VEHICLE WINDOW REGULATOR

BACKGROUND OF THE INVENTION

The present invention pertain to an improved window lifting mechanism for moving windowpanes in automobiles and other vehicles.

U.S. Pat. No. 4,168,595 issued Sept. 25, 1979 to Pickles et al, discloses a window regulator of the general type employing a guide track and flexible rack rotary-to-linear mechanism. The mechanism is operated by rotation of a drive gear intended to be manually actuated.

The U.S. Pat. No. 3,890,743 issued June 24, 1975 to Eckhardt et al discloses a vehicle window lifter having a pinion drive cable drum providing an inner cylindrical space arranged to support a clock spring. When the windowpane is lowered the spring will be tensioned to store some of the potential energy of the pane such that the stored energy will support the pane lifting process.

SUMMARY OF THE INVENTION

The present invention includes an improved counterbalancing pinion arrangement operative to mesh with a flexible toothed rack intermediate a windowpane raising and lowering drive gear and the rack's connection to the pane. The drive gear is operative to move the rack along a track in one direction during upward closing movement of the pane and to move the rack in the other direction during downward opening movement of the pane. An elongated spiral convolute spring extends about the axis of the pinion with the inner end of the spring secured to the fixed pinion shaft. A coupling is formed on the pinion rim and spaced radially inwardly therefrom for releasable engaging a hook formed on the spring's outer end portion. Upon rotation of the drive gear by a manual crank handle causing translation of the rack on its track in a first direction and resultant concurrent rotary movement of the counterbalance pinion. The spiral spring is operative to store a portion of the potential energy of the windowpane when the pane is lowered tending to at least partially counterbalance the weight of the window pane as it is moved upwardly by the translation of the rack in a second direction by the drive gear.

The pinion has a unique T-shaped releasable spiral spring hook capturing means formed on the interior of the pinion rim. The capturing means is reversely symmetrical which allows the pinion to be used interchangeably on either the right-hand or left-hand side of the vehicle. A blank portion is provided in the pinion's external teeth which blocks the movement of the flexible rack after a predetermined length of travel on the track preventing the separation of the rack from the track. This permits the window lift device device to be handled and transported as a subassembly prior to being mounted in the vehicle door.

BRIEF DESCRIPTION OF THE DRAWINGS

These and other features of the present invention will be more apparent from the following description and drawings in which.

DETAILED DESCRIPTION

Figure 1:
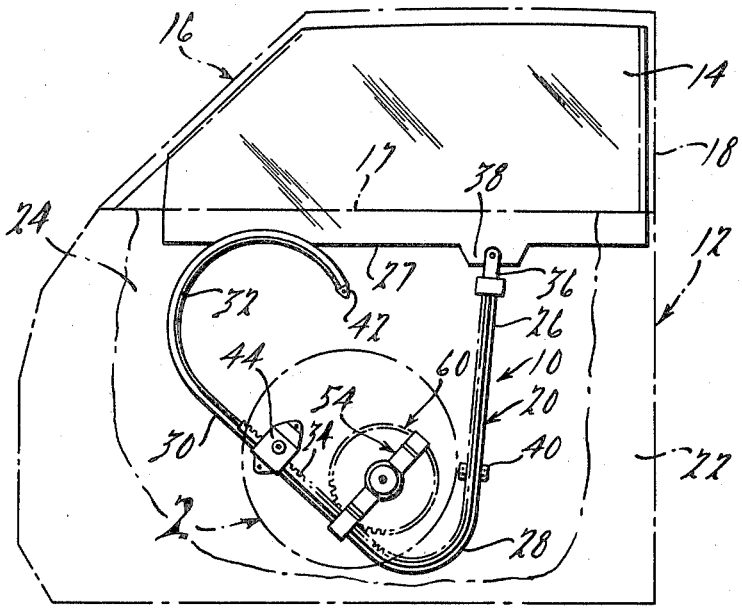
FIG. 1 is a side view of a right-hand automobile door with the inner panel broken away to illustrate a window regulator having an improved counterbalance device according to the present invention.

Referring now to FIG. 1 there is shown a window regulator assembly or mechanicam 10 mounted on an automobile door 12 operable to open and close a windowpane 14 in a door window opening defined by the door vehicle body 16, door upper edge 17 and window frame 18. The window regulator assembly 10 comprises a track 20 which is bendable into the configuration illustrated in FIG. 1 to conform it to the interior of the doorwell defined between the door's inner and outer panels 22 and 24.

The track 20 is of the type disclosed in the above mentioned U.S. Pat. No. 4,168,595 which is hereby incorporated by reference. The track comprises a generally upright linear portion 26 which conforms to the path of a portion of the bottom edge 27 of the glass windowpane 14. The track includes a curved intermediate portion 28, an upwardly oblique extending portion 30 and a curved terminating portion 32. Slidable longitudinally on the track 20 is a flexible driven member in the form of a rack 34 formed of suitable plastic such as nylon 37 101" and having a pivotal connector link 36 (FIG. 1) for attachment to lower extension 38 of the windowpane 14.

Figure 3:
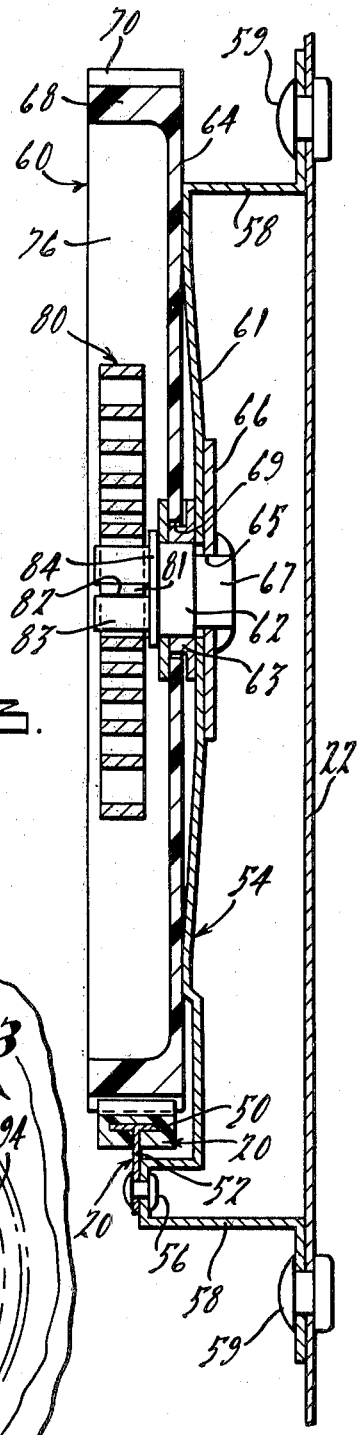
FIG. 3 is an enlarged fragmentary sectional view of the counterbalance device taken along the line 3—3 in FIG. 2.
Figure 2:
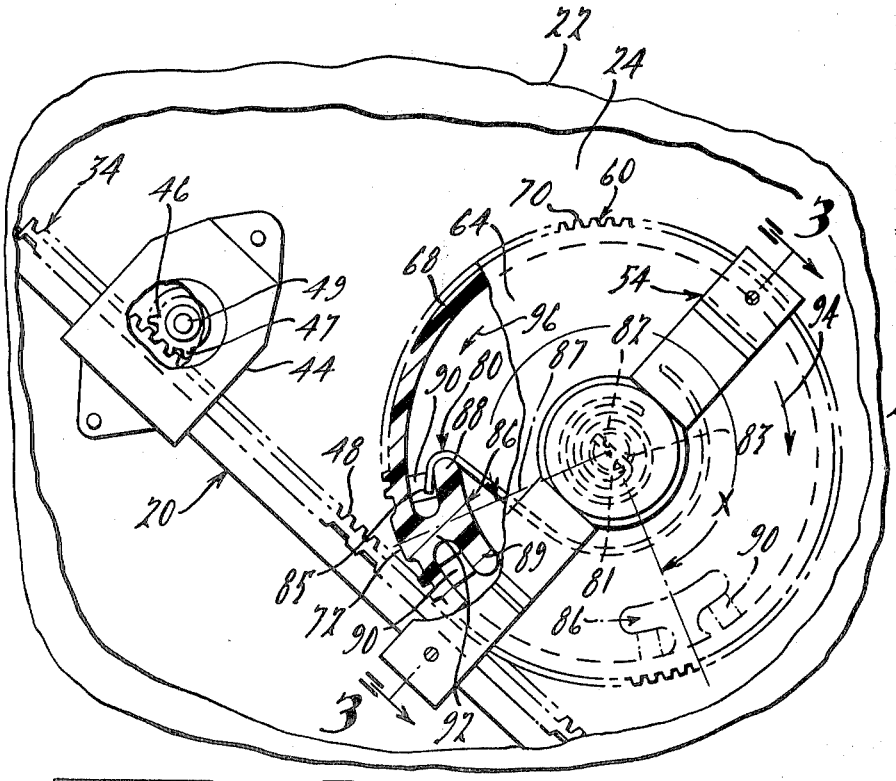
FIG. 2 is an enlarged view of the window counterbalance pinion device in FIG. 1.

The track 20 is retained on the inner door panel 22 within the doorwell by brackets 40 and 42. As seen in FIG. 2 the track portion 30 passes through a window crank and pinion gear housing 44 mounted in the inner door panel 22 containing a drive gear 46 having its teeth 47 meshing with teeth 48 formed on the rack drive side. The drive gear 46 is mounted on a first shaft 49 and may be manually driven by a crank handle (not shown) or motor driven to raise and lower the windowpane 14. The track 20, as disclosed in the 4,168,595 patent, is shown in FIG. 3 as metal and may be formed from an elongated strip bent into a generally T-shaped cross-section. The cross member 50 of the T provides two elongated, oppositvely extending guide flanges, which extend outwardly from the stem 52 of the T. The stem 52 has means for mounting the track in fixed position, as by mounting to support strap 54 shown riveted to stem 52 at 56. The strap 54 includes a pair of L-section end legs 58 having their feet riveted to the inner door panel 22 by pop rivets 59.

The present invention concerns an improved counterbalance pinion 60 rotatably mounted on the strap 54 by means of a second fixed shaft 62 journally supporting a grommet bearing 63 mounted in a central aperture 69 in disc portion 64 of the pinion 60. A double-D shaped aperture 65 is provided in a reinforcing plate 66 suitably affixed to the strap as by welding. The shaft 62 has a double-D sectioned end portion 67 conforming to aperture 65 to prevent rotation of the shaft 62. The shaft is axially retained by upsetting the end of its double-D portion 67. The counterbalance pinion 60 includes an outer wheel rim portion 68 having external teeth 70 extending therearound except for a blank, no-teeth segment or portion 72 for a purpose to be explained. The counterbalance pinion 60 has an open side defined by the asymmetrical pinion disc 64 forming an outwardly directed cylindrical space 76.

An elongated spiral convolute or clock spring 80 is located within the space 76 and extends about the axis of second shaft 62. The spiral spring 80 has an inner end portion 81 secured in a diametrical cross slot 82 of a stationary shaft head 83 located on shaft collar 84. The spring 80 has its outer end portion terminated in a hook 85 adapted to engage releasable retainer means in the form of a T-shaped "cleat-like" member 86 formed integral with the inner circumference of the pinion wheel rim 68. The cleat-like retainer 86 is symmetrical about radial line 87 to define a pair of mirror image lobes 88 and 89 supported by a radial central stem 92. Each lobe has a pair of radial extending sidewalls 90 which partially enclose the space between each lobe and its adjacent wheel rim portion to insure capture of the spring hook 85 by preventing transverse or axial movement of the hook. It will be noted that the cleat-like retainer 86 is designated to function with the counterbalance pinion 60 such that the pinion 60 may be used interchangeably on either side of a vehicle. It is thus an "un-handed" part as contrasted with a right or left handed part.

As best seen in FIG. 2 the counterbalance pinion 60 external gear teeth 70 extend around the periphery of the wheel 68 with the exception of the blank toothless segment 72. The counterbalance pinion has a predetermined diameter which allows its gear teeth to be driven by the rack through a defined angular distance "X" of about 270 degrees or until the window is fully lowered without reaching the blank segment 72 of the counterbalance pinion. Thus, the segment 72 does not interfere with the operation of the assembly upon its installation within a vehicle body. It will be noted, however, that the blank segment will prevent the pinion from rotating through a full 360° angle with the window regulator mechanism in its subassembly form. In this way the regulator device may be stored and handled as a separate subassembly until it is mounted in a vehicle door without spring 80 being inadvertently released.

It will be noted in FIG. 2 that for the right-hand side of the vehicle the pinion 60 is moved in a clockwise direction indicated by arrow 94 during a lowering of the windowpane 14 and in a counter-clockwise direction indicated by arrow 96 upon the windowpane being raised.

What is claimed is:

1. In a window regulator mechanism for a vehicle windowpane having an elongated track, an elongated flexible plastic rack provided with means for engaging said track supporting said rack for sliding motion longitudinally of said track, rack teeth integrally formed on the other side of said rack, said rack having means thereon for attachment to the windowpane, said track having a portion shaped to conform to the path of movement of the bottom edge of the windowpane and an extension curved to extend away from said path, drive gear means meshing with said rack teeth, and means connecting said drive gear means to a manual operator for rotating said drive gear means about a first shaft to effect linear translation of said rack and concurrent movement of said windowpane the improvement wherein a counterbalance pinion meshing with said rack teeth and operative to be rotated about a second fixed shaft in one rotary direction by travel of said rack during upward closing movement of said windowpane and in the other rotary direction by said rack during downward opening movement of said windowpane, an elongated spiral convolute spring having inner and outer end portions and an intermediate portion connecting said inner and outer end portions and extending about the axis of said second shaft, said inner end portion received in a diametrical slot of said second shaft, said outer end portion terminating in a hook adapted to engage releasable hook capturing means formed on the interior of the counterbalance pinion rim, rotation of said drive gear means by the manual operator in said one direction effecting translation of said rack on said track in a first direction and concurrent rotary movement of said counterbalance pinion in said one rotary direction such that the spring is operative for storing a portion of the potential energy of the windowpane when the pane is lowered tending to at least partially counterbalance the weight of the windowpane as it is moved upwardly by the translation of said rack in a second direction by the drive gear means by virtue of the stored energy action of the spring tending to rotate said counterbalance pinion in the other rotary direction thereby assisting in the raising of the windowpane; said counterbalance pinion including external gear teeth thereon meshing with said rack teeth, said external gear tooth having a blank no-tooth rack blocking segment thereon which blocks the movement of said rack after a predetermined length of travel on the track thereby preventing the separation of said rack from said track obviating said spring being inadvertently released when the mechanism is a subassembly prior to its being installed in the vehicle; said counterbalance pinion of a predetermined diameter such that said segment is located at a first angular location out of blocking contact with said rack teeth with said windowpane being fully raised, and wherein said pinion is rotated through an arcuate path by said rack in said other rotary direction through a predetermined angle such that said segment is rotated to a second angular location without said segment being moved into its rack blocking position upon said windowpane being fully lowered.

2. The mechanism defined in claim 1 which is further characterized in that said releasable hook capturing means is a T-shaped member having a stem portion extending radially inwardly from the pinion rim and an arm portion defining a pair of opposed lobes extending substantially normal to said stem, each said lobe defining a recessed undercut notch adapted for receiving said spring hook dependent upon each side of the vehicle the mechanism is used.

* * * * *